US005730443A

United States Patent [19]

Allen

[11] Patent Number: 5,730,443

[45] Date of Patent: Mar. 24, 1998

[54] METHOD OF PLAYING A GAME

[76] Inventor: Carl Edward Allen, 208 Millwood Ct., Colleyville, Tex. 76034

[21] Appl. No.: 590,189

[22] Filed: Jan. 23, 1996

[51] Int. Cl.[6] ..... A63B 71/02

[52] U.S. Cl. ..... 273/459; 273/317.5

[58] Field of Search ..... 273/459, 461, 273/429–432, 445, 440, 317.5, 108.4; 463/4

[56] References Cited

U.S. PATENT DOCUMENTS

| | | | |
|---|---|---|---|
| 3,767,197 | 10/1973 | Breslow | 273/431 |
| 3,883,137 | 5/1975 | Bengtson | 273/445 X |
| 4,141,548 | 2/1979 | Everton | 463/4 |
| 4,496,148 | 1/1985 | Morstain et al. | 463/4 X |
| 5,090,735 | 2/1992 | Meaney et al. | 273/461 X |
| 5,219,433 | 6/1993 | Zaruba et al. | 273/432 |
| 5,316,308 | 5/1994 | Stembokas | 273/440 X |
| 5,364,108 | 11/1994 | Esnouf | 273/432 X |

*Primary Examiner*—William E. Stoll

[57] ABSTRACT

FlagDown is an interactive (non-electronic) game that is played while watching a live or taped football game. The object of FlagDown is to receive the most penalty yardage by calling penalties as the live or taped football game is being played. The players of FlagDown compete between themselves by identifying penalties in the football game before their opponent and obtain yardage points by being the first to identify actual and/or potential penalties. Correctly identifying a penalty or potential penalty before the other opponents provides positive points. Incorrectly identifying penalties results in negative points. FlagDown can be played by a single player competing against their own past scores, single players competing with each other, teams competing with teams. Penalty flags, score keeper and game rules are included in package.

1 Claim, No Drawings

METHOD OF PLAYING A GAME

SUMMARY OF THE INVENTION

FlagDown is an interactive (non-electronic) game that is played while watching a live or taped football game. The object of FlagDown is to receive the most penalty yardage by calling penalties as the live or taped football game is being played. The players of FlagDown compete between themselves by identifying penalties in the football game before their opponent and obtain yardage points by being the first to identify actual and/or potential penalties. Correctly identifying a penalty or potential penalty before the other opponents provides positive points. Incorrectly identifying penalties results in negative points. FlagDown can be played by a single player competing against their own past scores, single players competing with each other, teams competing with teams. Penalty flags, score keeper and game rules are included in package.

DETAILED DESCRIPTION

1. Individual players or a team selected player will throw the supplied "FlagDown Flags" or alternative flags during the game as the players believe a penalty has occurred.

2. The first player (individual or team) to throw a flag has the chance to score yardage. However, if multiple penalties occur the player or team must throw first and call only one penalty.

3. If that player has called the correct penalty that player will receive as many as are awarded. The correct call is the call game referee identifies.

4. If that player can give the correct signal (includes pointing to the penalized team) that player will receive 4 additional bonus yards. The signal must be given within 5 seconds of throwing the flag and before the game referee displays the proper signal.

5. If that player can give the name and number of the penalized football player before it is announced by the game referee then the FlagDown player will receive 4 additional bonus yards.

6. If that player is incorrect on the penalty call then the player must deduct the penalty yardage for their called penalty off their score. If that player gives the wrong signal and/or the wrong name and number, no points shall be deducted.

7. If a player throws a flag and no penalty is called in the game being watched then each player but the player that threw the flag will receive 2 yards.

If the TV announcer says: That Could have been a penalty or words to that effect using Could then each player but the player that threw the flag will receive 1 yard.

If the TV announcer says: That Should have been a penalty or words to that effect using Should then each player but the player that threw the flag will receive 0 yards.

8. If any penalty is declined and the player calls the correct penalty then that player will receive half the appropriate yardage and/or bonus yardage.

9. If any penalty is declined and the player calls the incorrect penalty then that player will receive no yardage and/or bonus yardage.

10. The winner of the game has the most yards at the end of the football game being watched.

11. In the event of a tie the player who won the 2nd half (3rd & 4th quarters) wins the game.

I claim:

1. A method of playing an interactive sports game comprising:

a) providing a gaming apparatus including a plurality of throwable flags, a score keeping device and a set of rules;

b) distributing at least one flag to each player of the interactive game;

c) each player of the interactive game watching a sporting event including a plurality of players in which penalty yards may be assessed or infractions of the rules of the sporting event occur;

d) throwing a flag, during a play of the sporting event viewed, by a player of the interactive game when the player perceives that an infraction of the rules of their sporting event has occurred, and before identification of any infraction by any referee officiating the sporting event being played;

e) announcing the perceived infraction by the first player of the interactive game by throwing a flag before identification of any infraction by any referee officiating the sporting event being played;

f) comparing the infraction identified by any referee of the sporting event as having occurred on the play, if any, with the perceived infraction announced by the player of the interactive game; and g) operating the score keeping device in accordance with the results of the comparison of the player announced and referee identified infractions, if any, and wherein the step of operating the score keeping device comprises;

i) operating the score keeping device to add to the score of the player an amount equal to the penalty yardage assessed by the referee if at least one infraction identified by the referee and announced by the player are the same and the penalty yardage is accepted by the appropriate players of the sporting event ii) operating the score keeping device to add to the score of the player an amount equal to one half the penalty yardage assigned, by the rules of the sporting event, to the infraction identified by the referee if at least one infraction identified by the referee and announced by the player are the same and the penalty yardage is declined by the appropriate players of the sporting event; or iii) operating the score keeping device to subtract from the score of the player an amount equal to the penalty yardage assigned, by the rules of the sporting event, to the infraction announced by the player if all infractions identified by the referee are different from the infraction announced by the player; or iv) operating the score keeping device to add a predetermined amount to the score of every player except the player who announced a perceived infraction if no infraction is identified by the referee.

* * * * *